United States Patent [19]

Santi

[11] 4,036,267

[45] July 19, 1977

[54] DEVICE TO DETECT THE BELT TENSION OF WEFT INSERTING MEMBERS IN SHUTTLELESS LOOMS

[75] Inventor: Luciano Santi, Florence, Italy

[73] Assignee: Officine Galileo Meccanotessile S.p.A., Florence, Italy

[21] Appl. No.: 712,063

[22] Filed: Aug. 5, 1976

[30] Foreign Application Priority Data

Aug. 7, 1975 Italy ..... 9509/75

[51] Int. Cl.[2] ..... D03D 51/18

[52] U.S. Cl. ..... 139/336; 200/61.18

[58] Field of Search ..... 139/110, 336, 429, 449; 66/157; 57/78; 200/61.18 X

[56] References Cited

U.S. PATENT DOCUMENTS

| | | | |
|---|---|---|---|
| 907,131 | 12/1908 | Cutting | 139/336 |
| 3,247,662 | 4/1966 | Jaeggli | 200/61.18 |
| 3,354,627 | 11/1967 | Cizek et al. | 200/61.18 |
| 3,734,144 | 5/1973 | Remond | 139/336 |

*Primary Examiner*—Henry S. Jaudon

[57] ABSTRACT

A device to detect the tension uniformity of a belt in a weft inserting member of a shuttleless loom wherein a belt anchored at its ends to fixed contiguous points and guided by rollers on a movable carriage with reciprocating motion serves to to control a gripper for laying down weft threads. The device comprises a cylindrical anchoring body on which an end of the belt is partly wound, there being interposed between the anchoring body and the belt section an elastic member mounted on the anchoring body and urged by the belt section against the body by the tension in the belt. Upon slackening of the belt, the elastic member displaces the belt section to produce closure of a switch which detects the reduction in the belt tension.

7 Claims, 4 Drawing Figures

DEVICE TO DETECT THE BELT TENSION OF WEFT INSERTING MEMBERS IN SHUTTLELESS LOOMS

FIELD OF THE INVENTION

The present invention relates to a device to detect the tension uniformity of a belt in weft inserting members of shuttleless looms of the type wherein grippers serving to lay down the weft are controlled by a belt anchored at both ends to fixed points and guided by rollers located on a movable carriage having a reciprocation motion.

SUMMARY OF THE INVENTION

According to the invention, the anchoring of one or both belt ends is effected by an anchoring body (in particular cylindrical) around which the belt end is partly wound, an elastic means being located between the body and the belt end which tends to displace the belt section wound on said body in the case of reduction in the belt tension. Additionally, means are provided, of electrical contact type or the like, to detect this displacement.

Advantageously, two contiguous anchoring bodies, for anchoring both belt ends, both have an elastic expansion means arranged in such a manner that the wound belt sections tend to come closer to each other in the case of a slackening of the belt, a single detecting means being located between both anchoring bodies.

According to one embodiment, said detecting means has two opposed contacts, one or both belt sections acting on each thereof when said belt is expanded due to reduction in the tension.

In practice, the elastic displacement means comprises a flat spring which rests on the respective anchoring body when it is resiliently loaded by the taut belt, while when the belt is slackened said flat spring is released and thus displaces.

With this arrangement various disadvantages encountered in known devices for the same purpose are avoided. In particular, the device according to the invention is sensitive both in the advance and the return stroke of the weft inserting member, which is required in order to ensure the timely signalling of possible breakage. In the construction according to the invention, in particular with two springs and two winding bodies, it is possible to signal the slackening of one or the other belt branch.

Other advantages both in the operation and in the construction will be apparent to those skilled in the art from the following description of a particular embodiment of the device.

BRIEF DESCRIPTION OF THE DRAWING

The invention will be better understood from the following description and the accompanying drawing which shows one nonrestrictive embodiment of the invention. In the drawing.

DETAILED DESCRIPTION

Figure 1:
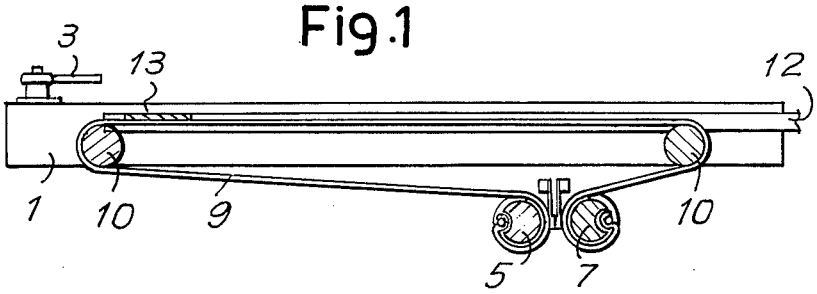
FIGS. 1 and 2 diagrammatically show, in respective positions, a weft inserting member provided with a movable carriage with guide means for the belt, which is anchored to two fixed winding bodies.

In the drawing all conventional parts of the shuttleless loom which are not necessary for understanding the present invention have been omitted.

Numeral 1 denotes a movable carriage or slide with reciprocating motion which, for example, can be controlled by a rod system 3 with a controlling device of any known type which is adapted to operate the weft inserting gripper synchronously with the other loom movements. Numerals 5 and 7 represent two fixed anchoring bodies, of substantially cylindrical form, to which both ends of a belt 9 are anchored, which belt serves to control the gripper. Belt 9 is wound on two rollers 10 mounted on the carriage 1. The carriage 1 also has guiding means for a weft inserting rod 12 which is anchored at 13 to the upper active branch of the belt 9 extending between rollers 10 for a quick and broad movement of the rod 12 and thus of the gripper to be operated. By moving the carriage from the position shown in FIG. 1 to the position shown in FIG. 2, the rod 12 is moved by the belt 9 sliding around both rollers 10 on which it is wound, said belt being anchored to the fixed anchoring bodies 5 and 7. This results in accelerated and broadened movement of the rod 12 with respect to the movement of the carriage 1. The arrangement up to this point is substantially of conventional type.

Figure 2:
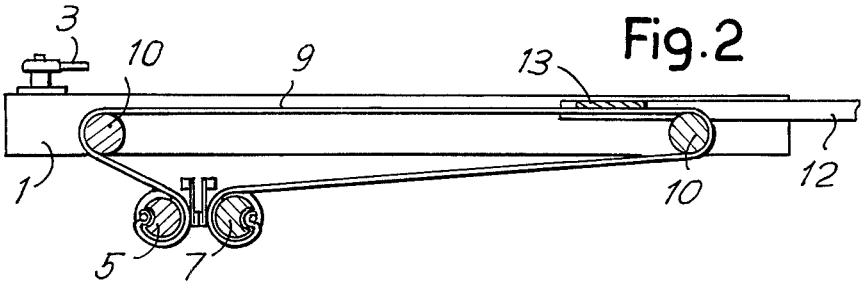

The device of this invention serves to detect the arrangement of the belt and thus in particular the belt tension both in the advance and the return stroke, i.e. both in the conditions of movement from the position in FIG. 1 to the position in FIG. 2 and in the conditions of movement from the position in FIG. 2 to the position in FIG. 1; in both said stages one of said two belt ends becomes stretched owing to the forces of inertia and acceleration.

Figure 3:
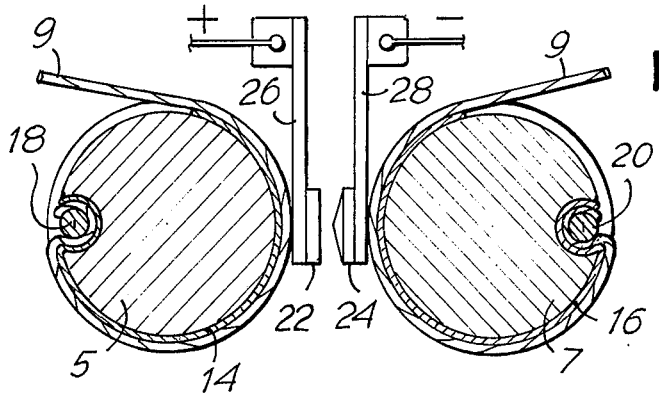
FIGS. 3 and 4 show an enlarged detail of FIG. 1 of the connection of the detector and the winding bodies with their respective springs, in the usual operative arrangement and in the arrangement wherein a slackening of the belt is detected, respectively.

In order to effect the signalling, on each anchoring body 5 and 7, there is mounted a respective flat spring 14 and 16. The springs 14 and 16 are secured at supports 18 and 20, respectively, to the respective anchoring bodies 5, 7 together with the corresponding end of the belt 9. The flat springs 14 and 16 are of such form as to tend to expand radially, being wound around and biased against the cylindrical surface of the anchoring bodies 5 and 7, the forcing action on said springs 14 and 16 being effected by the ends of the belt 9 which are symmetrically wound on their respective anchoring bodies 5 and 7. Under normal tension conditions, the ends of the taut belt 9 tend to bias springs 14 and 16 against their respective anchoring bodies 5 and 7, as shown in FIG. 3. At this stage, a circuit between two contact terminals 22 and 24 remains open, said terminals being carried by two elastic blades 26 and 28 suitably fitted and extending in substantially parallel relation for the mechanical and spaced support of both contacts 22 and 24. The terminals are electrically connected in a circuit (not shown) serving to signal or to stop the machine in the case of making of the circuit due to slackening of the belt and for the reasons to be given hereinafter. When one or both belt branches slackens beyond a given limit, it no loner counteracts the stress of the respective springs 14, 16 and the spring expands radially with respect to the body 5 or 7 and enlarges the winding diameter of the belt 9 and accordingly acts on the corresponding element 22 and 26 or 24 and 28 of the detector. The signalling or operative circuit is closed to carry out the above signalling operation or to stop the machine.

Figure 4:
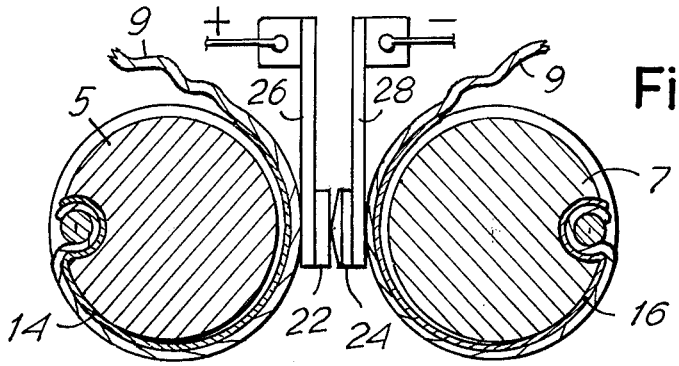

The closing of the circuit between the terminals 22 and 24 can be affected by the expansion of both springs 14 and 16, as shown in FIG. 4, or by the expansion of only one of the springs 14, 16, which allows signalling non-uniformity caused by the slackening of the belt at any time during the advance and return strokes of the working cycle of the belt at each insertion. It is thus possible to signal timely and immediately any unevenness in the belt with the possibility of a very quick stoppage of the machine.

It is intended that the drawing only show one practical embodiment of the invention, said invention being variable in its form and arrangement without departing from the scope and spirit thereof. For instance, provision could be made for an isolated arrangement of the described anchoring system of each belt end to act on an electrical contact sensing change in the winding diameter and thus the displacement of the belt end which is wound over the anchoring body, the respective spring being located therebetween. There could even be provided a single spring wound on one of the anchoring bodies to signal a possible unevenness, i.e. possible slackening of one end of the belt 9 and thus of the section of said belt contiguous to said end.

What is claimed is:

1. A device to detect the tension uniformity of a belt in a weft inserting member of a shuttleless loom of the type having a belt anchored at its ends to fixed contiguous points, guide rollers for said belt, and a movable carriage supporting said rollers and movable with reciprocating motion to control a gripper for insertion of weft threads, said device comprising a cylindrical anchoring body on which one belt end is partly wound, an elastic means mounted on said body and disposed between the belt end and said body, said elastic means having resiliency and tending to displace the belt section wound on said body and serving to displace the belt section in the event of a reduction in the belt tension, and means for detecting such displacement of the belt section.

2. A device as claimed in claim 1 wherein said means for detecting displacement of the belt section comprises an electrical contact element.

3. A device as claimed in claim 2 wherein said elastic means comprises a flat spring having one end secured to said body and tending to straighten from said body and urge said belt section away therefrom.

4. A device as claimed in claim 3 wherein said flat spring is resilient so as to be urged by the tension in the belt against the anchoring body.

5. A device as claimed in claim 2 wherein two contiguously spaced anchoring bodies are provided adjacent one another, the opposite ends of the belt being mounted on a respective said anchoring body with interposition of a respective said elastic means, the arrangement of said elastic means being such that they cause the belt sections to approach one another in the event of belt slackening, said detecting means being disposed between said bodies.

6. A device as claimed in claim 5 wherein said detecting means comprises two of said electrical contact elements facing one another in normally spaced relation, said contact elements being proximate respective belt ends for being acted on thereby to bring said contact elements into contact with one another when the belt slackens.

7. A device as claimed in claim 6 wherein said detecting means comprises flexible blades carrying said contact elements.

* * * * *